US011866935B2

(12) United States Patent
Ebisawa

(10) Patent No.: US 11,866,935 B2
(45) Date of Patent: Jan. 9, 2024

(54) REBAR-EQUIPPED LUMBER FORM AND CONSTRUCTION METHOD USING REBAR-EQUIPPED LUMBER FORM

(71) Applicant: MITSUBISHI ESTATE CO., LTD., Tokyo (JP)

(72) Inventor: Wataru Ebisawa, Tokyo (JP)

(73) Assignee: MITSUBISHI ESTATE CO., LTD., Tokyo (JP)

( * ) Notice: Subject to any disclaimer, the term of this patent is extended or adjusted under 35 U.S.C. 154(b) by 24 days.

(21) Appl. No.: 17/595,635

(22) PCT Filed: May 11, 2020

(86) PCT No.: PCT/JP2020/018792

§ 371 (c)(1),
(2) Date: Nov. 19, 2021

(87) PCT Pub. No.: WO2020/235372

PCT Pub. Date: Nov. 26, 2020

(65) Prior Publication Data

US 2022/0259854 A1 Aug. 18, 2022

(30) Foreign Application Priority Data

May 22, 2019 (JP) ..... 2019-096206

(51) Int. Cl.
*E04B 5/38* (2006.01)
*E04C 5/06* (2006.01)

(52) U.S. Cl.
CPC ..... *E04B 5/38* (2013.01); *E04C 5/0622* (2013.01); *E04B 2103/02* (2013.01)

(58) Field of Classification Search
CPC ..... E04B 1/16; E04B 5/38; E04B 2103/02; E04C 5/0622
See application file for complete search history.

(56) References Cited

U.S. PATENT DOCUMENTS 2,844,024 A * 7/1958 McDonald ..... E04B 5/38 52/649.1
2008/0155924 A1* 7/2008 Degen ..... E04B 1/6116 52/655.1

FOREIGN PATENT DOCUMENTS

| | | | |
|---|---|---|---|
| CN | 104863296 A | | 8/2015 |
| CN | 105464267 A | | 4/2016 |
| CN | 109667375 A | | 4/2019 |
| DE | 1060122 B | * | 6/1959 |
| DE | 2038961 A1 | * | 2/1972 |
| DE | 9316295 U1 | * | 2/1994 |

(Continued)

OTHER PUBLICATIONS

An Office Action mailed by China National Intellectual Property Administration dated Aug. 16, 2022, which corresponds to Chinese Patent Application No. 202080036865.7 and is related to U.S. Appl. No. 17/595,635; with English language translation.

(Continued)

*Primary Examiner* — Christine T Cajilig
(74) *Attorney, Agent, or Firm* — Studebaker & Brackett PC

(57) ABSTRACT

Provided are a rebar-equipped lumber form and a construction method using a rebar-equipped lumber form capable of shortening construction time by replacing a deck plate. The lumbering form 10 includes a wood panel 11, and a unitized rebar 12 disposed and fixed on the wood panel 11.

10 Claims, 18 Drawing Sheets

(56) References Cited

FOREIGN PATENT DOCUMENTS

| | | | | |
|---|---|---|---|---|
| FR | 1202259 | A | * | 1/1960 |
| JP | S55-068960 | A | | 5/1980 |
| JP | S57-044803 | U | | 3/1982 |
| JP | S58-159301 | U | | 10/1983 |
| JP | H04-069522 | U | | 6/1992 |
| JP | 2536267 | Y2 | | 5/1997 |
| JP | 2012-087484 | A | | 5/2012 |
| JP | 2017-071987 | A | | 4/2017 |
| JP | 2017-078307 | A | | 4/2017 |
| KR | 20-0368256 | Y1 | | 11/2004 |
| KR | 2009-0090611 | A | | 8/2009 |
| KR | 10-0991017 | B1 | | 10/2010 |
| KR | 10-2011-0082269 | A | | 7/2011 |
| KR | 10-1429482 | B1 | | 8/2014 |
| KR | 2015-0093983 | A | | 8/2015 |
| KR | 10-1747104 | B1 | | 6/2017 |
| WO | 2017/061533 | A1 | | 4/2017 |

OTHER PUBLICATIONS

International Search Report issued in PCT/JP2020/018792; dated Jul. 21, 2020.

Office Action issued in JP 2019-096206; mailed by the Japanese Patent Office dated Jul. 14, 2020.

Office Action issued in JP 2019-096206; mailed by the Japanese Patent Office dated Dec. 15, 2020.

Office Action issued in KR 10-2020-7023128; mailed by the Korean Intellectual Property Office dated Oct. 14, 2021.

Written Opinion issued by the Intellectual Property Office of Singapore dated Sep. 23, 2022, which corresponds to Singaporean Patent Application No. 11202112773V and is related to U.S. Appl. No. 17/595,635.

* cited by examiner

Fig. 11C

TABLE 1: TEST RESULTS

| EXAMPLE | CONFIGURATION OF FIXING FITTING | TENSILE LOAD RESISTANCE [kN] |
|---|---|---|
| 1 | U NAIL ×1 | 0.320 |
| 2 | U NAIL ×1 | 0.290 |
| 3 | F CABLE IRON SADDLE ×1 | 3.243 |
| 4 | F CABLE IRON SADDLE ×1 | 3.222 |
| 5 | STAPLE ×1 | 0.288 |
| 6 | STAPLE ×1 | 0.212 |
| 7 | U NAIL ×2 | 0.470 |
| 8 | U NAIL ×2 | 0.409 |
| 9 | U NAIL ×4 | 1.242 |
| 10 | ADHESIVE STAPLE ×1 | 2.639 |
| 11 | ADHESIVE STAPLE ×1 | 3.396 |
| 12 | ADHESIVE STAPLE ×1 | 1.824 |
| 13 | ADHESIVE STAPLE ×2 | 3.663 |
| 14 | ADHESIVE STAPLE ×2 | 3.738 |
| 15 | ADHESIVE STAPLE ×2 | 3.953 |

REBAR-EQUIPPED LUMBER FORM AND CONSTRUCTION METHOD USING REBAR-EQUIPPED LUMBER FORM

TECHNICAL FIELD

The present disclosure relates to a rebar-equipped lumber form and a construction method using a rebar-equipped lumber form.

BACKGROUND ART

In a conventional construction method, a deck plate is laid on steel beams, then the deck plate is welded and integrated with the steel beams, then reinforcing bars are disposed on the deck plate, and concrete is placed to construct a reinforced concrete (RC) floor.

Japanese Patent Application Laid-Open No. 2012-087484 proposes a joint structure configured to connect a deck plate with a steel beam without requiring welding.

SUMMARY OF INVENTION

A rebar-equipped lumber form according to an aspect of an embodiment includes:

a wood panel; and a unitized rebar disposed and fixed on the wood panel.

A method of manufacturing a rebar-equipped lumber form according to an aspect of an embodiment includes:

disposing a unitized rebar on a wood panel, and fixing a lower part of the unitized rebar to the wood panel.

A construction method according to an aspect of an embodiment is a construction method in form rebar construction work for an RC floor, the method including:

a step of hoisting a rebar-equipped lumber form having a wood panel and a unitized rebar disposed and fixed on the wood panel, and laying the rebar-equipped lumber form on steel beams in a direction such that a surface of the wood panel, to which the unitized rebar is not fixed, is exposed downward from between the steel beams; and a step of placing concrete on the rebar-equipped lumber form.

A building according to an aspect of an embodiment includes:

steel beams;

a rebar-equipped lumber form laid on the steel beams, the rebar-equipped lumber form having a wood panel and a unitized rebar disposed and fixed on the wood panel; and concrete placed on the rebar-equipped lumber form, in which a surface of the wood panel of the rebar-equipped lumber form, to which the unitized rebar is not fixed, is exposed downward from between the steel beams.

BRIEF DESCRIPTION OF DRAWINGS

FIG. 11C is a table showing test results of a tensile load test.

DESCRIPTION OF EMBODIMENTS

Figure 1:
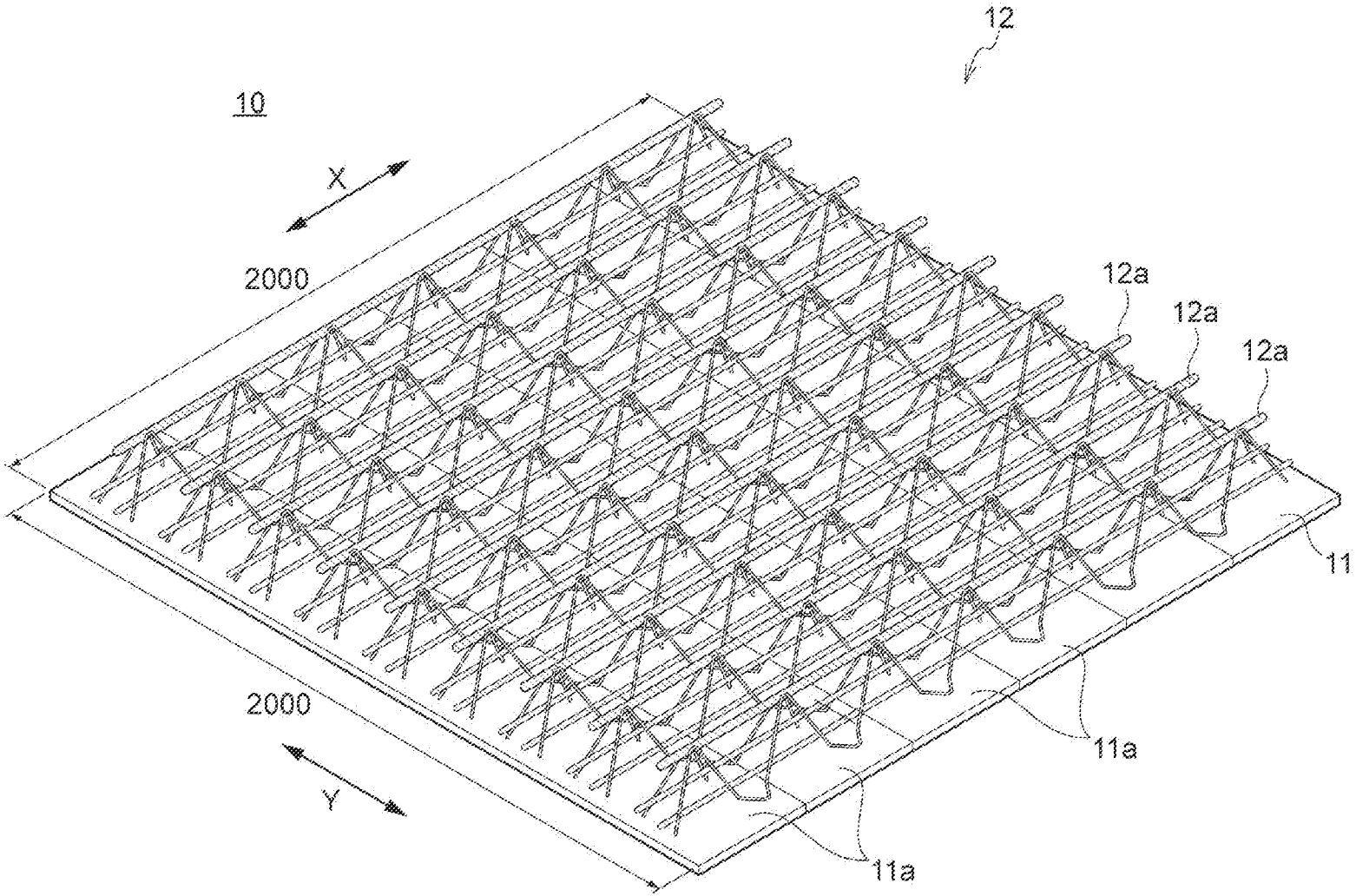
FIG. 1 is a perspective view illustrating a rebar-equipped lumber form according to a first embodiment.

A conventional construction method has a problem that construction takes time, since it is necessary to weld a deck plate to steel beams and dispose reinforcing bars on the deck plate after the deck plate constituting the form is laid on the steel beams.

The embodiments described below have been made in view of the above points, and an object thereof is to provide a rebar-equipped lumber form and a construction method using a rebar-equipped lumber form capable of shortening the construction time by replacing a deck plate.

A rebar-equipped lumber form according to a first aspect of an embodiment includes:

a wood panel; and a unitized rebar disposed and fixed on the wood panel.

According to such an aspect, since the panel part of the form is made of wood, it is unnecessary to weld the form to the steel beams after laying the form on the steel beams unlike the deck plate. Moreover, since the unitized rebar is fixed on the wood panel, it is unnecessary to perform the rebar arrangement construction work on site after laying the form on the steel beams, and it is possible to support the span from a beam to another beam without holding the span with timbering or the like until the strength of concrete is exhibited. Furthermore, in a state where the form is laid on the steel beams, since the surface of the wood panel is exposed downward from between the steel beams, the surface of the wood panel exposed from between the steel beams can be utilized as it is as a finishing material, and the finishing material, the base material thereof, and the like can be omitted. Accordingly, by utilizing a rebar-equipped lumber form in place of the deck plate, the construction time can be significantly shortened, and the finishing material and the base material thereof can be omitted, so that the cost can be reduced.

A rebar-equipped lumber form according to a second aspect of an embodiment is the rebar-equipped lumber form according to the first aspect, further including a fixing fitting configured to fix the unitized rebar to the wood panel.

A rebar-equipped lumber form according to a third aspect of an embodiment is the rebar-equipped lumber form according to the first or second aspect, in which the unitized rebar is fixed to the wood panel with an adhesive.

A rebar-equipped lumber form according to a fourth aspect of an embodiment is the rebar-equipped lumber form according to any one of the first to third aspects, in which the length of a long side of the wood panel is equal to or longer than 1,000 mm.

According to such an aspect, it is possible to bridge the form between a beam and another beam of the steel beams.

A rebar-equipped lumber form according to a fifth aspect of an embodiment is the rebar-equipped lumber form according to any one of the first to fourth aspects, in which the wood panel includes a plurality of laminas arranged adjacent to each other in a width direction, and laminas adjacent to each other in the width direction are bonded and fixed to each other with an adhesive, or laminas adjacent to each other in the width direction are connected with and fixed to each other with a staple.

A rebar-equipped lumber form according to a sixth aspect of an embodiment is the rebar-equipped lumber form according to any one of the first to fifth aspects, in which the unitized rebar is a rebar truss.

According to such an aspect, since a rebar truss that is the unitized rebar has a truss-like structure, it is possible to more reliably support the span from a beam to another beam without holding the span with timbering or the like until the strength of the concrete is exhibited when the concrete is placed.

According to such an aspect, even a wood panel having a large area can be prepared relatively easily.

A rebar-equipped lumber form according to a seventh aspect of an embodiment is the rebar-equipped lumber form according to the sixth aspect, in which the rebar truss has:

a first rebar member that is disposed above and spaced apart from a surface of the wood panel and extends linearly along a first direction parallel to a surface of the wood panel;

a pair of second rebar members extending in the first direction while repeatedly bending in a vertical direction between the first rebar member and the wood panel, the pair of second rebar members each having an upper part facing the first rebar member, a lower part facing the wood panel, and an intermediate part extending between the upper part and the lower part; and a pair of third rebar members that are each disposed adjacent to the intermediate part of each of the pair of second rebar members and extend linearly along the first direction, an upper part of each of the pair of second rebar members is welded to the first rebar member, a lower part of each of the pair of second rebar members is fixed to the wood panel with the fixing fitting, and a part of an intermediate part of each of the pair of second rebar members, the part facing each of the pair of third rebar members, is welded to each of the pair of third rebar members.

A rebar-equipped lumber form according to an eighth aspect of an embodiment is the rebar-equipped lumber form according to the seventh aspect, in which the pair of second rebar members are arranged in mirror-image symmetry to each other with a plane extending perpendicularly to a surface of the wood panel from the first rebar member as a plane of symmetry, and the pair of third rebar members are arranged in mirror-image symmetry to each other with a plane extending perpendicularly to a surface of the wood panel from the first rebar member as a plane of symmetry.

A rebar-equipped lumber form according to a ninth aspect of an embodiment is the rebar-equipped lumber form according to the sixth aspect, in which the rebar truss has:

a first rebar member that is disposed above and spaced apart from a surface of the wood panel and extends linearly along a first direction parallel to a surface of the wood panel;

a second rebar member extending in a second direction perpendicular to the first direction while repeatedly bending in a vertical direction between the first rebar member and the wood panel, the second rebar member having an upper part facing the first rebar member and a lower part facing the wood panel;

a third rebar member that is disposed between the first rebar member and the wood panel and extends linearly along the first direction; and a fourth rebar member extending in the first direction while repeatedly bending in a vertical direction between the first rebar member and the third rebar member, the fourth rebar member having an upper part facing the first rebar member and a lower part facing the third rebar member, an upper part of the second rebar member is welded to the first rebar member, a lower part of the second rebar member is fixed to the wood panel with the fixing fitting, an upper part of the fourth rebar member is welded to the first rebar member, and a lower part of the fourth rebar member is welded to the third rebar member.

A rebar-equipped lumber form according to a tenth aspect of an embodiment is the rebar-equipped lumber form according to the sixth aspect, in which the rebar truss has:

a first rebar member that is disposed above and spaced apart from a surface of the wood panel and extends linearly along a first direction parallel to a surface of the wood panel;

a second rebar member that is disposed between the first rebar member and the wood panel and extends linearly along the first direction;

a third rebar member extending in the first direction while repeatedly bending in a vertical direction between the first rebar member and the second rebar member, the third rebar member having an upper part facing the first rebar member and a lower part facing the second rebar member; and a fourth rebar member extending in a second direction perpendicular to the first direction so as to intersect with the first rebar member, an upper part of the third rebar member is welded to the first rebar member, and a lower part of the third rebar member is welded to the second rebar member and fixed to the wood panel with the fixing fitting.

A method of manufacturing a rebar-equipped lumber form according to an eleventh aspect of an embodiment includes:

disposing a unitized rebar on a wood panel, and fixing a lower part of the unitized rebar to the wood panel.

A construction method according to a twelfth aspect of an embodiment is a construction method in form rebar construction work for an RC floor, the method including:

a step of laying a rebar-equipped lumber form according to any one of the first to tenth aspects on steel beams in a direction such that a surface of the wood panel, to which the unitized rebar is not fixed, is exposed downward from between the steel beams; and a step of placing concrete on the rebar-equipped lumber form.

A building according to a thirteenth aspect of an embodiment includes:

steel beams;

a rebar-equipped lumber form according to any one of the first to tenth aspects laid on the steel beams; and concrete placed on the rebar-equipped lumber form, in which a surface of the wood panel of the rebar-equipped lumber form, to which the unitized rebar is not fixed, is exposed downward from between the steel beams.

The following description will explain specific examples of an embodiment in detail with reference to the accompanying drawings. In the drawings, components having equivalent functions are denoted by the same reference numerals, and detailed description of the components having the same reference numerals will not be repeated. Moreover, in the drawings, the scale, the aspect ratio in length and width, and the like are appropriately changed and exaggerated from those of the actual ones for the sake of easy understanding of the illustration.

In the present specification, a "lamina" refers to a smallest unit of a sawn board (including those prepared by joining and bonding sawn plates in the length direction with the fiber directions adjusted to be substantially parallel to each other, those prepared by bonding small square members in the width direction with the fiber directions parallel to each other, and those prepared by further joining and bonding the same in the length direction.) constituting a wood panel.

First Embodiment

Figure 3:
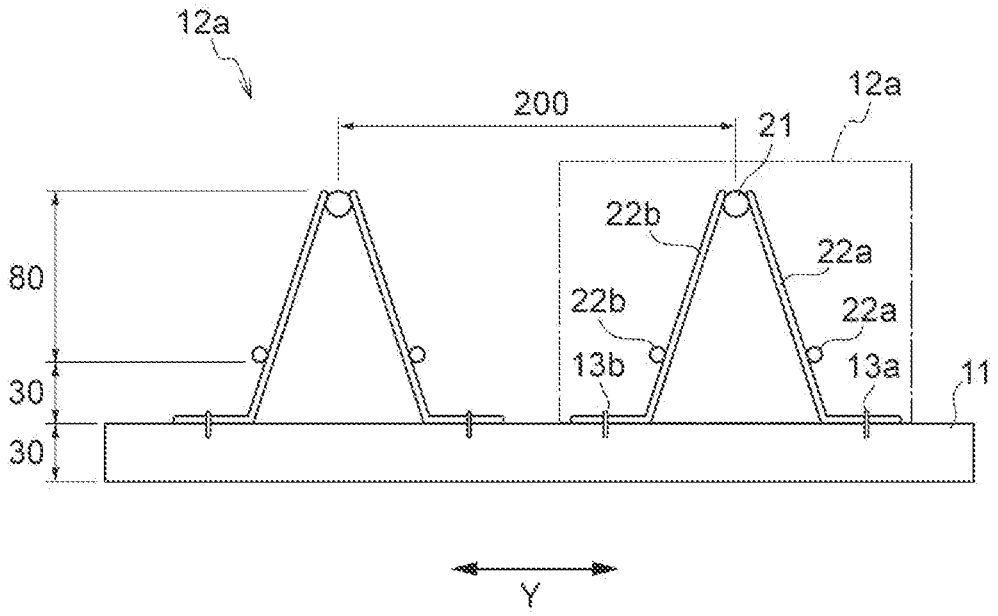
FIG. 3 is an enlarged cross-sectional view of a part of the rebar-equipped lumber form according to the first embodiment.

FIG. 1 is a perspective view illustrating a rebar-equipped lumber form 10 according to the first embodiment. FIG. 3 is an enlarged cross-sectional view of a part of the rebar-equipped lumber form 10 according to the first embodiment.

As illustrated in FIGS. 1 and 3, the rebar-equipped lumber form 10 has a wood panel 11, a unitized rebar 12 disposed on the wood panel 11, and fixing fittings 13*a* and 13*b* configured to fix the unitized rebar 12 to the wood panel 11. In FIG. 1, illustration of the fixing fittings 13*a* and 13*b* is omitted.

As illustrated in FIG. 1, the wood panel 11 has a quadrangular shape in plan view. The length of the long side of the wood panel 11 is not particularly limited as long as the wood panel 11 can be bridged from a beam to another beam of steel beams 31 and 32 (see FIGS. 9 and 10), and is, for example, equal to or longer than 1,000 mm, or is 2,000 mm in the illustrated example. The short side of the wood panel 11 may be, for example, equal to or longer than 200 mm, since rounding is performed on site. The thickness of the wood panel 11 is 30 mm, for example.

In the example illustrated in FIG. 1, the wood panel 11 includes a plurality of laminas 11*a* arranged adjacent to each other in the width direction (X direction in FIG. 1). In the wood panel 11, laminas 11*a* adjacent to each other in the width direction (X direction) are bonded and fixed to each other with an adhesive. As the adhesive, an aqueous polymer-based adhesive is used, for example, and more specifically, an isocyanate-based adhesive or a resorcinol-based adhesive is used, for example. As one variation, in the wood panel 11, laminas 11*a* adjacent to each other in the width direction (X direction) may be connected with and fixed to each other with staples or the like. Since the wood panel 11 includes the plurality of laminas 11*a*, even a wood panel 11 having a large area with each side equal to or longer than 1,000 mm can be prepared relatively easily.

Figure 2:
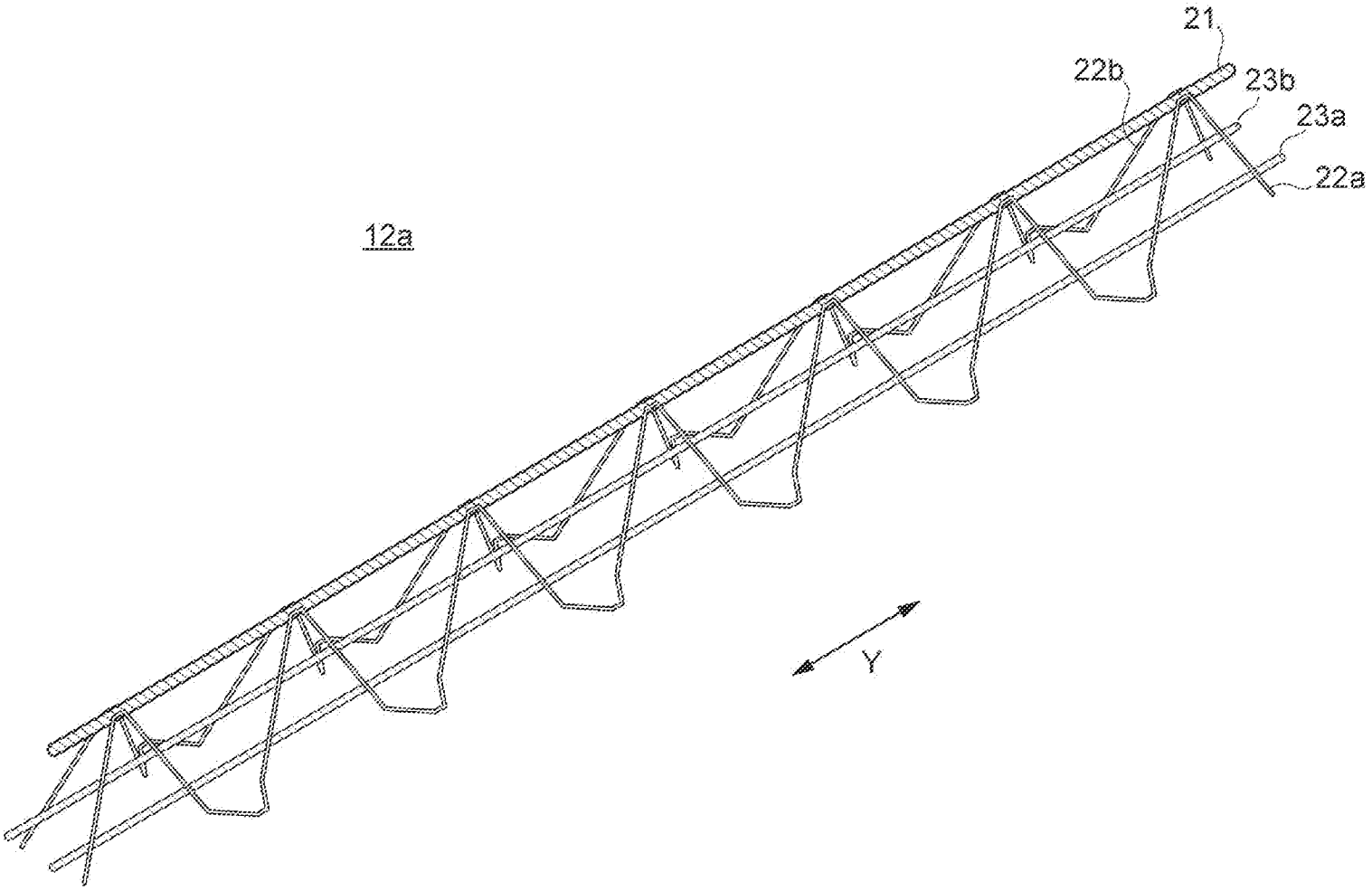
FIG. 2 is an enlarged perspective view illustrating a part (unit rebar truss) of a rebar truss included in the rebar-equipped lumber form according to the first embodiment.

For example, a rebar truss is used as the unitized rebar 12. Hereinafter, a rebar truss may be denoted by reference numeral 12. In the present embodiment, the rebar truss 12 has a plurality of unit rebar trusses 12*a* arranged adjacent to each other in a uniaxial direction (Y direction in the illustrated example) on the wood panel 11 as illustrated in FIG. 1. FIG. 2 is an enlarged perspective view illustrating a unit rebar truss 12*a* that is a part of the rebar truss 12.

As illustrated in FIGS. 2 and 3, each unit rebar truss 12*a* has a first rebar member 21, a pair of second rebar members 22*a* and 22*b*, and a pair of third rebar members 23*a* and 23*b*.

The first rebar member 21 is disposed above and spaced apart from the surface of the wood panel 11, and extends linearly along a first direction (X direction in the illustrated example) parallel to the surface of the wood panel 11.

Each of the pair of second rebar members 22*a* and 22*b* extends in the first direction (X direction) while repeatedly bending in a triangular wave shape (zigzag) in the vertical direction between the first rebar member 21 and the wood panel 11. As illustrated in FIG. 3, the pair of second rebar members 22*a* and 22*b* may be arranged in mirror-image symmetry to each other with a virtual plane extending perpendicularly to the surface of the wood panel 11 from the first rebar member 21 as a plane of symmetry.

Each of the pair of second rebar members 22*a* and 22*b* has an upper part facing the first rebar member 21, a lower part facing the wood panel 11, and an intermediate part extending between the upper part and the lower part. An upper part (i.e., a bent part facing the first rebar member 21) of each of the pair of second rebar members 22*a* and 22*b* is welded to the first rebar member 21.

Each of the pair of third rebar members 23*a* and 23*b* is disposed adjacent to an intermediate part of each of the pair of second rebar members 22*a* and 22*b*, and extends linearly along the first direction (X direction). As illustrated in FIG. 3, the pair of third rebar members 23*a* and 23*b* may be arranged in mirror-image symmetry to each other with a virtual plane extending perpendicularly to the surface of the wood panel 11 from the first rebar member 21 as a plane of symmetry.

A part of an intermediate part of each of the pair of second rebar members 22*a* and 22*b* facing each of the pair of third rebar members 23*a* and 23*b* is welded to each of the pair of third rebar members 23*a* and 23*b*.

Specific dimensions of the first rebar member 21, the second rebar members 22*a* and 22*b*, and the third rebar members 23*a* and 23*b* may be appropriately determined according to required floor performance. For example, the diameters of the first rebar member 21 and the third rebar members 23*a* and 23*b* are 10 to 20 mm, and the diameters of the second rebar members 22*a* and 22*b* are 5 to 10 mm. Moreover, the interval between the upper end of the first rebar member 21 and the upper surface of the wood panel 11 is 110 mm, for example, and the interval between the lower ends of the third rebar members 23*a* and 23*b* and the upper surface of the wood panel 11 is 30 mm, for example.

As illustrated in FIG. 3, lower parts (i.e., bent parts facing the wood panel 11) of the pair of second rebar members 22*a* and 22*b* are bent to extend in directions opposite to each other along the surface of the wood panel 11, and are fixed to the wood panel 11 with the fixing fittings 13*a* and 13*b*.

Figure 4:
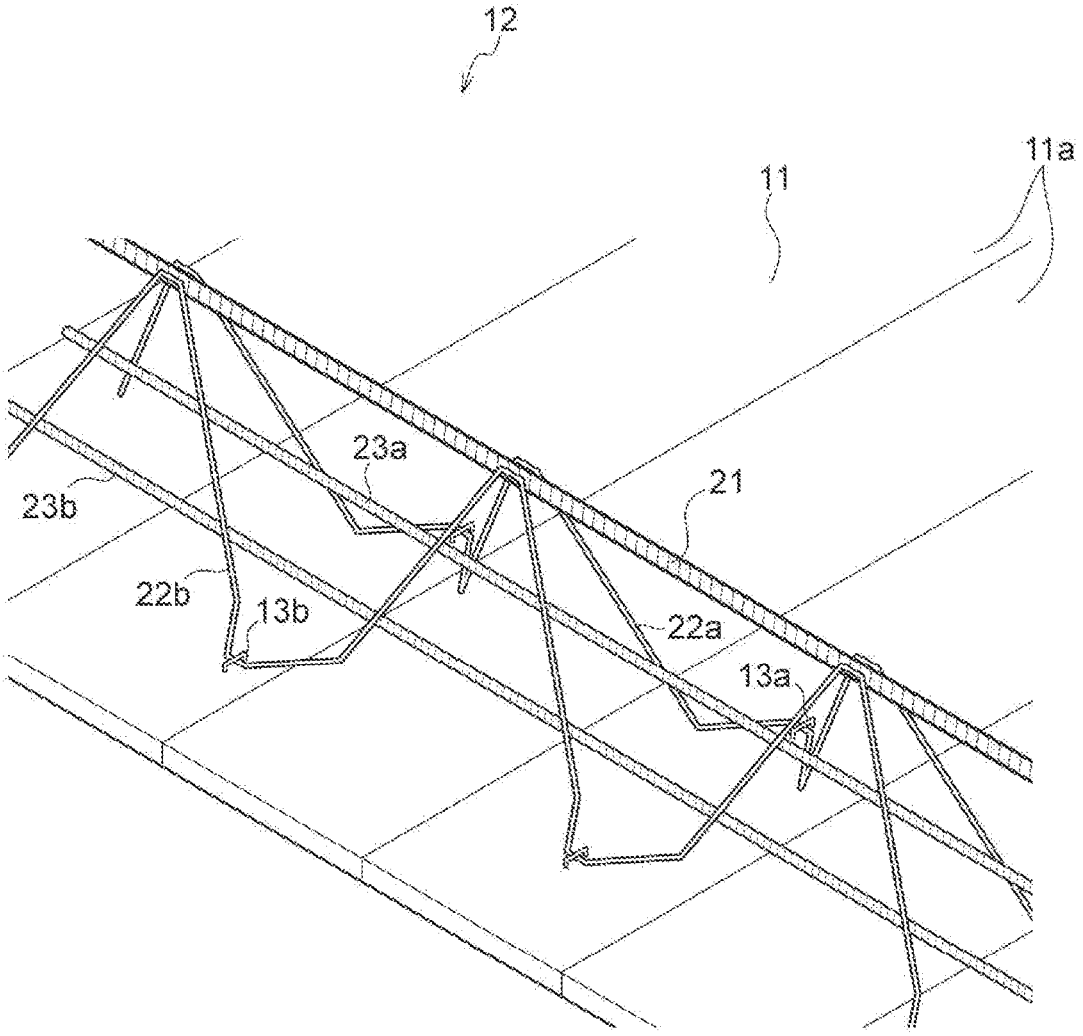
FIG. 4 is a view for explaining an example of a fixing fitting.

As an example, staples having a channel shape, for example, staples for construction, furniture, woodwork, and packaging (type K) defined in JIS A5556:2012 may be used as the fixing fittings 13*a* and 13*b* as illustrated in FIG. 4. Although the second rebar members 22*a* and 22*b* are fixed with one staple for one spot of the lower part (one bent part facing the wood panel 11) in the example illustrated in FIG. 4, the present invention is not limited this, and the second rebar members 22*a* and 22*b* may be fixed with two or more staples for one spot of the lower part according to required performance. Adhesive staples or barbed staples may be used to increase the tensile strength.

Figure 5:
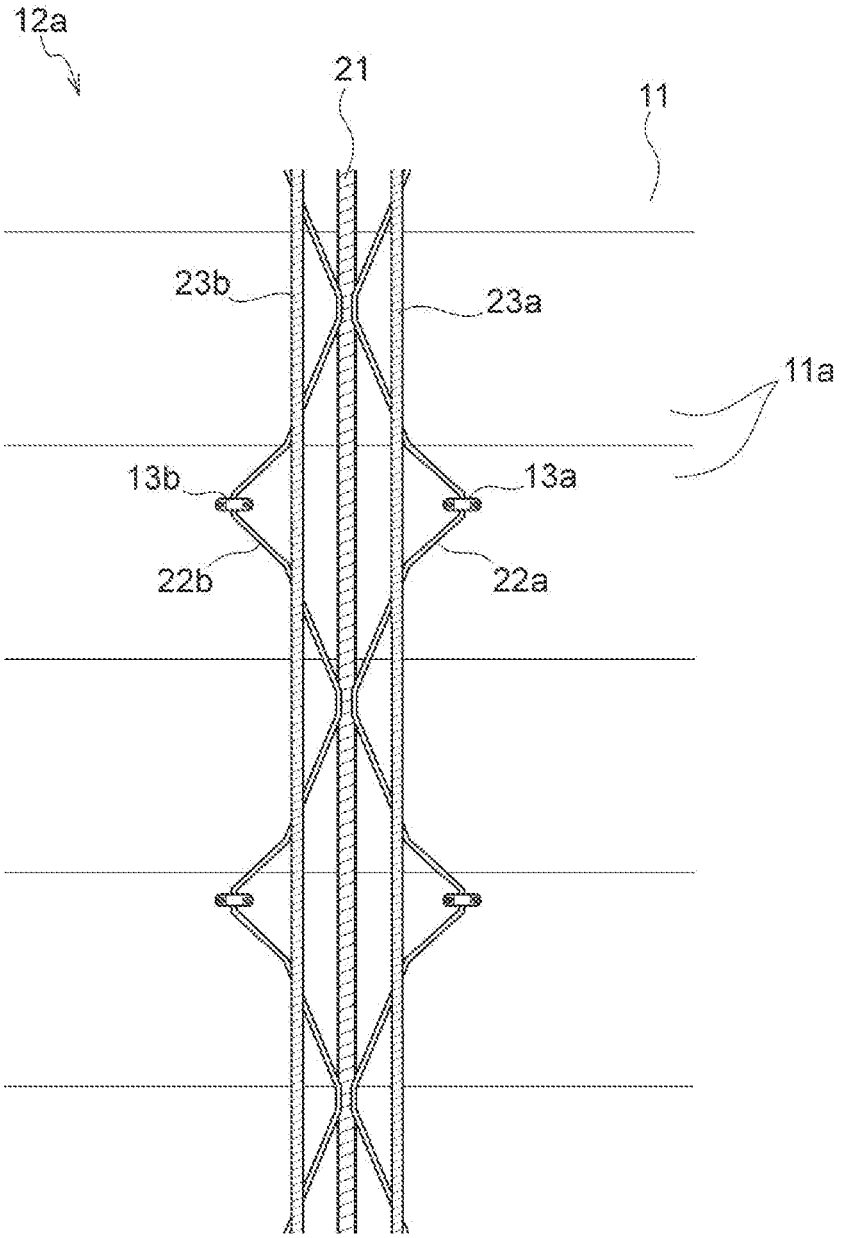
FIG. 5 is a view for explaining another example of a fixing fitting.

As another example, a flat type (F) cable iron saddle, and two fixing screws for screwing both ends of the F cable iron saddle to the wood panel 11 may be used as the fixing fittings 13*a* and 13*b* as illustrated in FIG. 5. Although the second rebar members 22*a* and 22*b* are fixed with one F cable iron saddle for one spot of the lower part (one bent part facing the wood panel 11) in the example illustrated in FIG. 5, the present invention is not limited this, and the second rebar members 22*a* and 22*b* may be fixed with two or more F cable iron saddles for one spot of the lower part according to required performance. Since two fixing screws are driven for one iron saddle, it is desirable that the number of iron saddles used for one spot of the lower part of the second rebar members 22*a* and 22*b* is small from the viewpoint of workability and cost.

Figure 6:
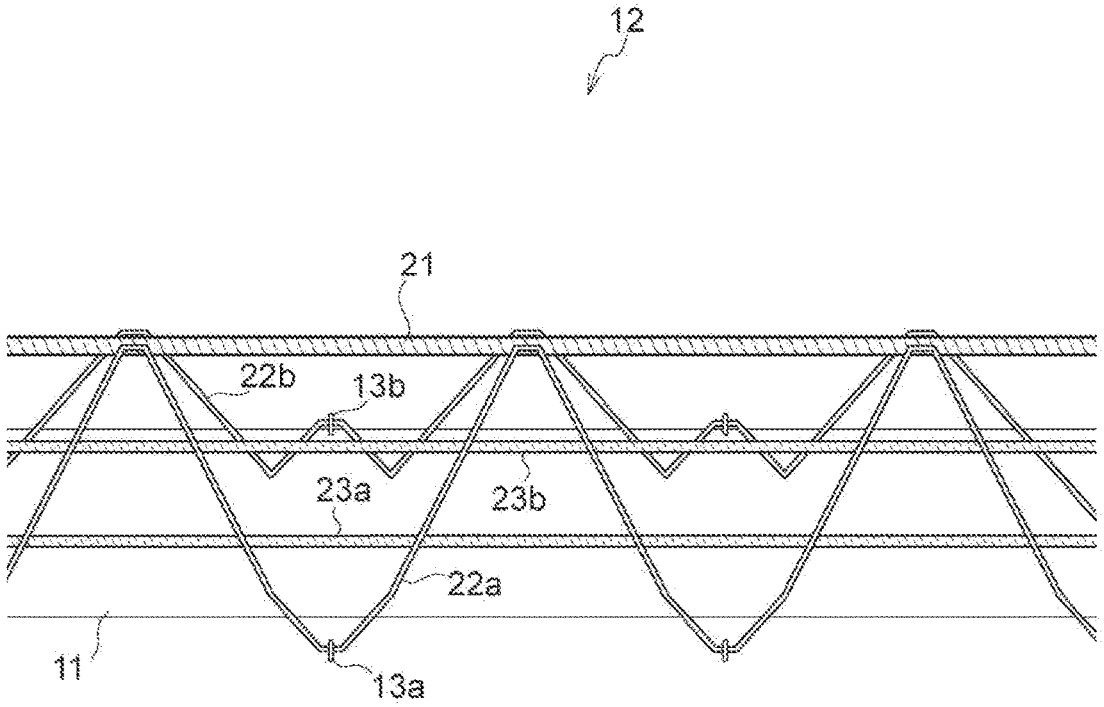
FIG. 6 is a view for explaining still another example of a fixing fitting.

As still another example, U nails having a "U" shape may be used as the fixing fittings 13*a* and 13*b* as illustrated in FIG. 6. Although the second rebar members 22*a* and 22*b* are fixed with two U nails for one spot of the lower part (one bent part facing the wood panel 11) in the example illustrated in FIG. 6, the present invention is not limited this, and the second rebar members 22*a* and 22*b* may be fixed with one U nail or three or more U nails for one spot of the lower part according to required performance. Adhesive U nails or barbed U nails may be used to increase the tensile strength.

Referring to FIG. 1, the plurality of unit rebar trusses 12*a* constituting the rebar truss 12 may be arranged at equal intervals on the wood panel 11. The distance between the centers of unit rebar trusses 12*a* adjacent to each other in the Y direction is 200 mm, for example.

(Method of Manufacturing Rebar-Equipped Lumber Form)

Next, an example of a method of manufacturing the rebar-equipped lumber form 10 will be described with reference to FIGS. 7, 8, and 1.

Figure 7:
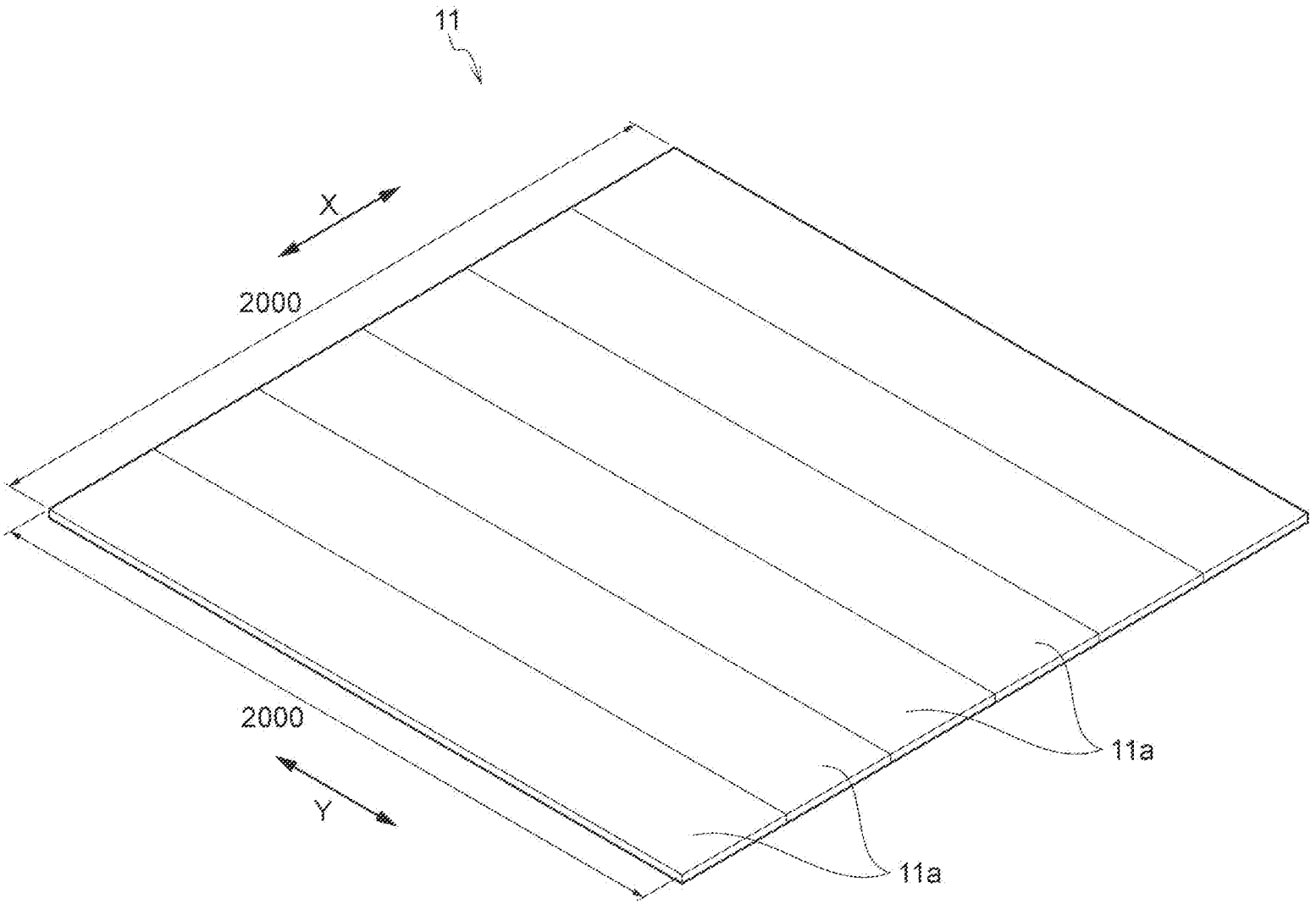
FIG. 7 is a view for explaining an example of a method of manufacturing a rebar-equipped lumber form according to the first embodiment.

First, as illustrated in FIG. 7, a plurality of laminas 11*a* are arranged adjacent to each other in the width direction (X direction in the illustrated example), and laminas 11*a* adjacent to each other in the width direction (X direction) are bonded and fixed to each other with an adhesive. As one variation example, laminas 11*a* adjacent to each other in the width direction (X direction) may be connected with and fixed to each other with staples or the like. As a result, a wood panel 11 having a large area is obtained.

Figure 8:
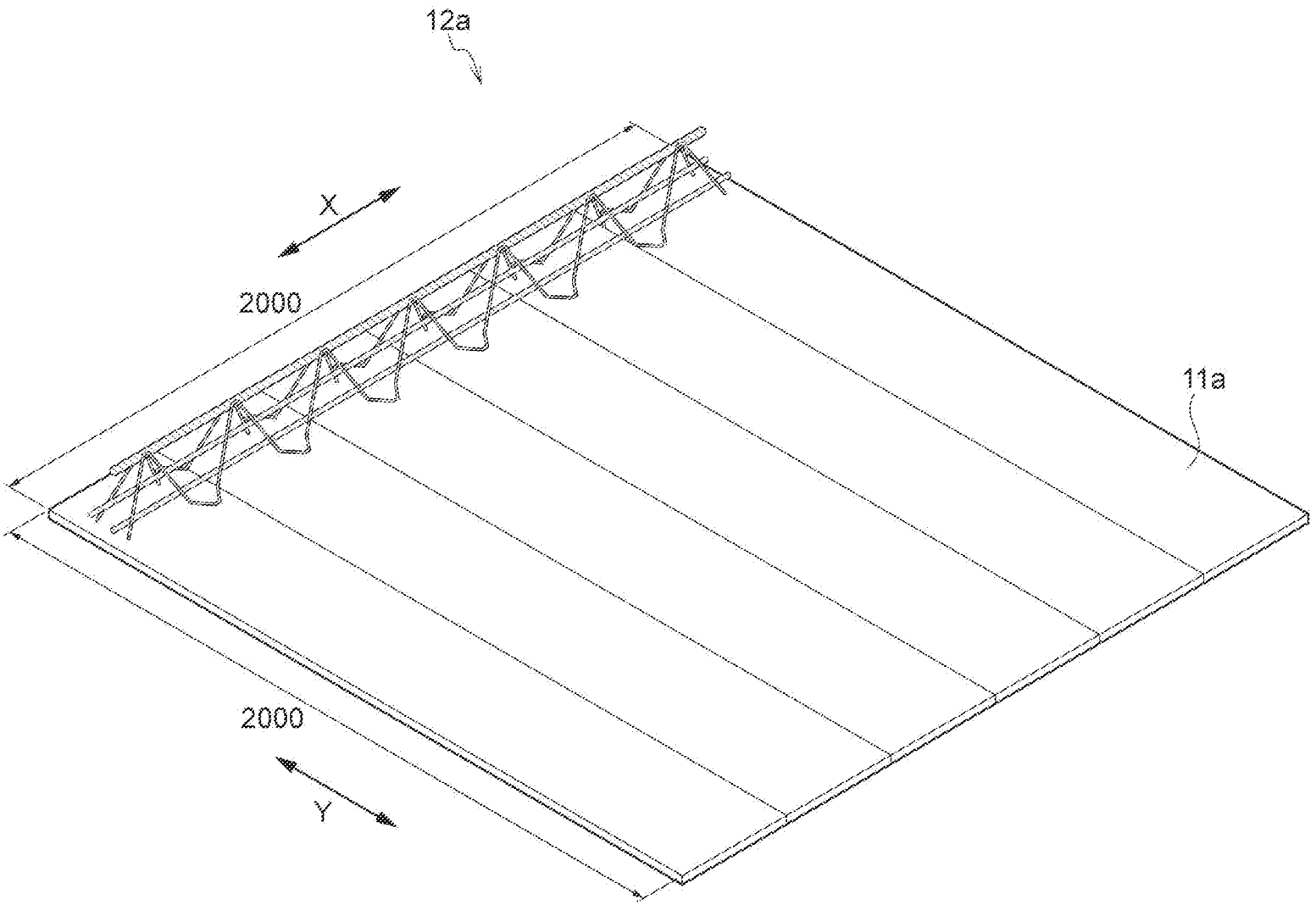
FIG. 8 is a view for explaining an example of a method of manufacturing a rebar-equipped lumber form according to the first embodiment.

Next, as illustrated in FIG. 8, unitized rebar, that is, a unit rebar truss 12*a* including one first rebar member 21, a pair of second rebar members 22*a* and 22*b*, and a pair of third rebar members 23*a* and 23*b* welded to each other in the illustrated example is disposed on the wood panel 11. As illustrated in FIG. 8, the unit rebar truss 12*a* may be disposed such that the first rebar member 21, the second rebar members 21*a* and 21*b*, and the third rebar members 22*b*, 23*a*, and 23*b* extend in a direction parallel to the width direction (X direction) of the laminas 11*a*. In this case, since the first rebar member 21, the second rebar members 22*a* and 22*b*, and the third rebar members 23*a* and 23*b* extend at a right angle with respect to the bonding surfaces between the laminas 11*a*, the strength of the wood panel 11 including the plurality of laminas 11*a* can be increased.

Then, a lower part of the unit rebar truss 12*a* disposed on the wood panel 11, more specifically, a lower part of each of the pair of second rebar members 22*a* and 22*b* is fixed to the wood panel 11 with the fixing fittings 13*a* and 13*b* (see FIG. 3).

Next, as illustrated in FIG. 1, the work or disposing another unit rebar truss 12*a* on the wood panel 11 and fixing a lower part of each of the pair of second rebar members 22*a* and 22*b* to the wood panel 11 with the fixing fittings 13*a* and 13*b* is repeated, so that the rebar truss 12 including a plurality of unit rebar trusses 12*a* can be fixed on the wood panel 11, and therefore the rebar-equipped lumber form 10 is obtained.

EXAMPLES

Figure 11A:
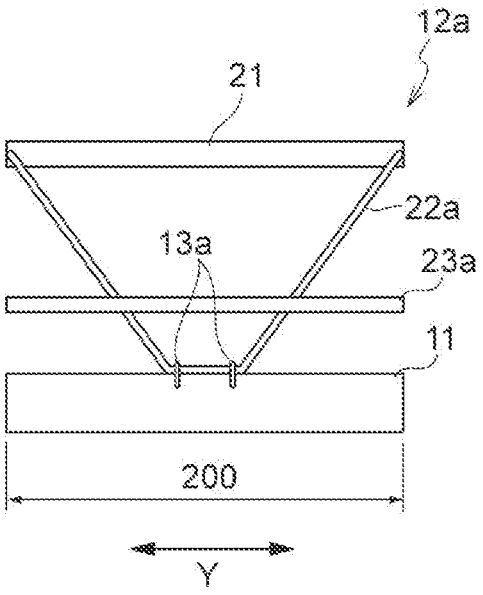
FIG. 11A is a side view illustrating the configuration of a rebar-equipped lumber form used in a tensile load test as viewed from the Y direction.
Figure 11B:
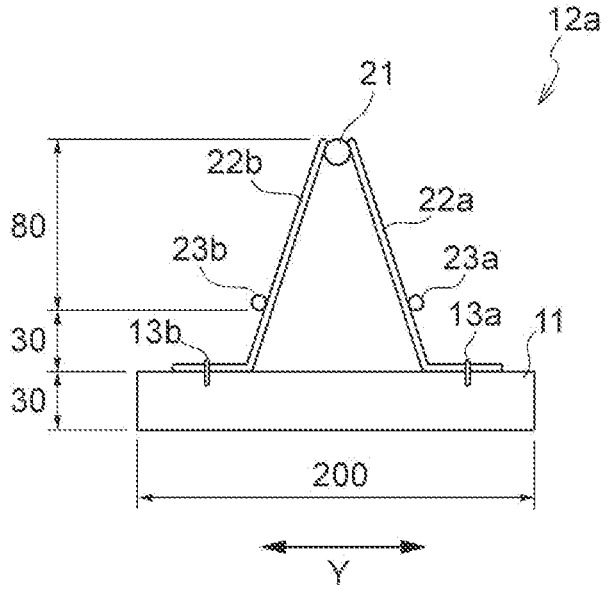
FIG. 11B is a side view illustrating the configuration of a rebar-equipped lumber form used in a tensile load test as viewed from the X direction.

Next, specific examples will be described. As illustrated in FIGS. 11A and 11B, the tensile load test was performed on a rebar-equipped lumber form 10, in which a unit rebar truss 12*a* was cut at a length corresponding to bending of second rebar members 22*a* and 22*b* back and forth one time in the vertical direction and the cut unit rebar truss 12*a* was fixed on a wood panel 11 having a size of 200 mm×200 mm with fixing fittings 13*a* and 13*b*, while changing the type of the fixing fittings 13*a* and 13*b*.

That is, as each of a first example and a second example, a rebar-equipped lumber form 10 fixed with one U nail for one spot of the lower part (one bent part facing the wood panel 11) of each of the pair of second rebar members 22*a* and 22*b* was prepared.

Moreover, as each of a third example and a fourth example, a rebar-equipped lumber form 10 fixed with one F cable iron saddle and two fixing screws for screwing both ends of the F cable iron saddle to the wood panel 11 for one spot of the lower part each of the pair of second rebar members 22*a* and 22*b* was prepared.

Moreover, as each of a fifth example and a sixth example, a rebar-equipped lumber form 10 fixed with one staple for one spot of the lower part of each of the pair of second rebar members 22*a* and 22*b* was prepared.

Moreover, as each of a seventh example and an eighth example, a rebar-equipped lumber form 10 fixed with two U nails for one spot of the lower part of each of the pair of second rebar members 22*a* and 22*b* was prepared.

Moreover, as a ninth example, a rebar-equipped lumber form 10 fixed with four U nails for one spot of the lower part of each of the pair of second rebar members 22*a* and 22*b* was prepared.

Moreover, as each of tenth to twelfth examples, a rebar-equipped lumber form 10 fixed with one adhesive staple for each spot of the lower part of each of the pair of second rebar members 22*a* and 22*b* was prepared.

Moreover, as each of thirteenth to fifteenth examples, a rebar-equipped lumber form 10 fixed with two adhesive staples for one spot of the lower part of each of the pair of second rebar members 22*a* and 22*b* was prepared.

With respect to the rebar-equipped lumber forms 10 according to the first to fifteenth examples, a tensile load (which will be hereinafter referred to as a tensile load resistance) was measured while a first rebar member 21 gripped by the arm of the tensile tester was pulled away from (upward) the wood panel 11 in a state where the wood panel 11 was horizontally fixed on the stage of the tensile tester with a jig until the fixing fittings 13*a* and 13*b* were broken or the fixing fittings 13*a* and 13*b* were pulled out from the wood panel 11.

FIG. 11C shows test results of the tensile load test. As shown in FIG. 11C, the tensile load resistance of the rebar-equipped lumber forms 10 according to the first to fifteenth examples was 0.320, 0.290, 3.243, 3.222, 0.288, 0.212, 0.470, 0.409, 1.242, 2.639, 3.396, 1.824, 3.663, 3.738, and 3.953 kN, respectively.

According to the test results shown in FIG. 11C, in a case where the required performance is assumed to be a yield strength of 1 kN and the design reference value in view of variations is assumed to be a yield strength of 2 kN, it can be said that it is desirable to adopt, as the fixing fittings 13*a* and 13*b*, (1) a configuration in which each of the pair of second rebar members 22*a* and 22*b* is fixed with one F cable iron saddle and two fixing screws for screwing both ends of the F cable iron saddle to the wood panel 11 for one spot of the lower part (one bent part facing the wood panel 11) (the third and fourth examples), or (2) a configuration in which each of the pair of second rebar members 22*a* and 22*b* is fixed with one or two adhesive stables for one spot of the lower part (the eleventh to fifteenth examples). However, since two fixing screws are driven for one iron saddle in the configuration (1), it is more desirable to adopt the configuration (2) from the viewpoint of workability and cost.

(Method of Using Rebar-Equipped Lumber Form)

Figure 9:
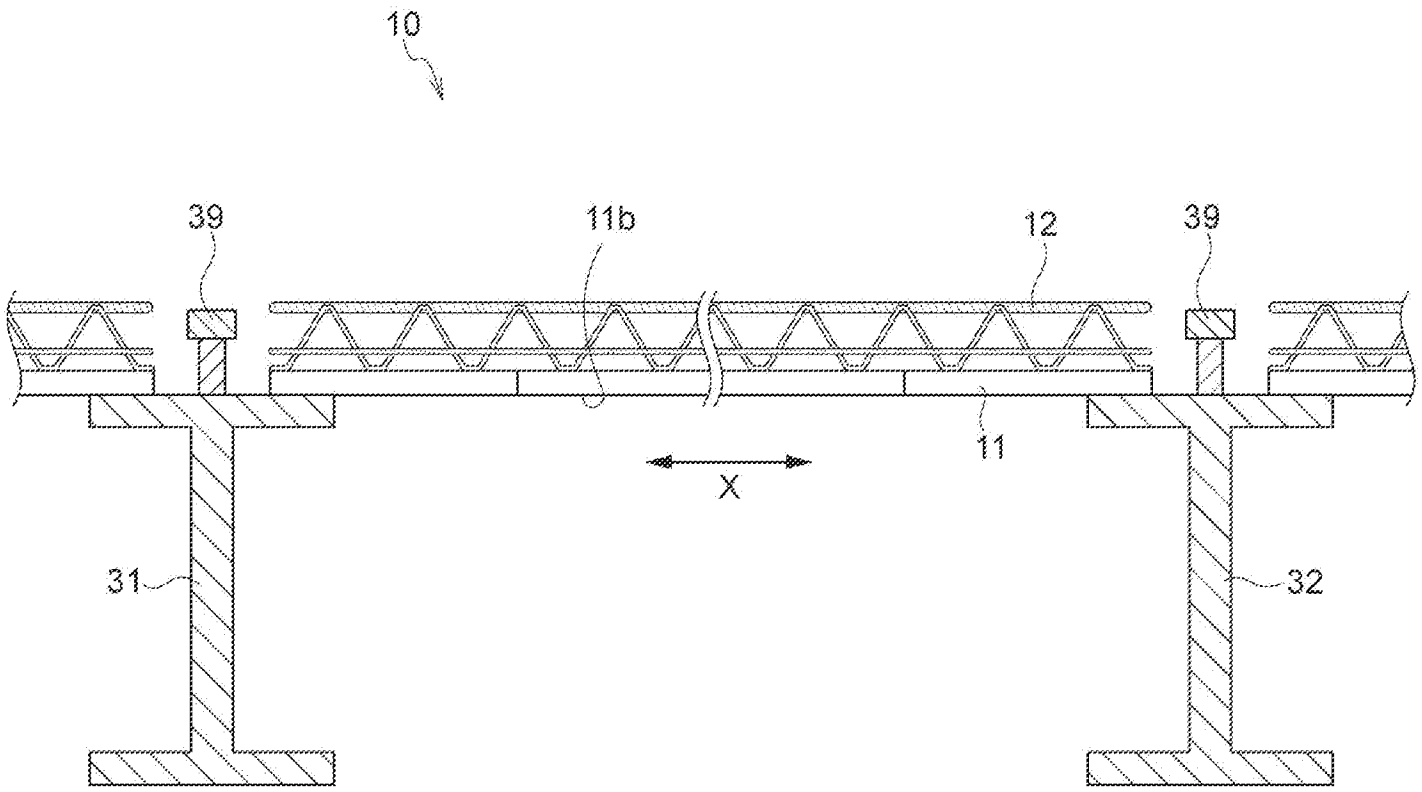
FIG. 9 is a view for explaining an example of a method of using a rebar-equipped lumber form according to the first embodiment.
Figure 10:
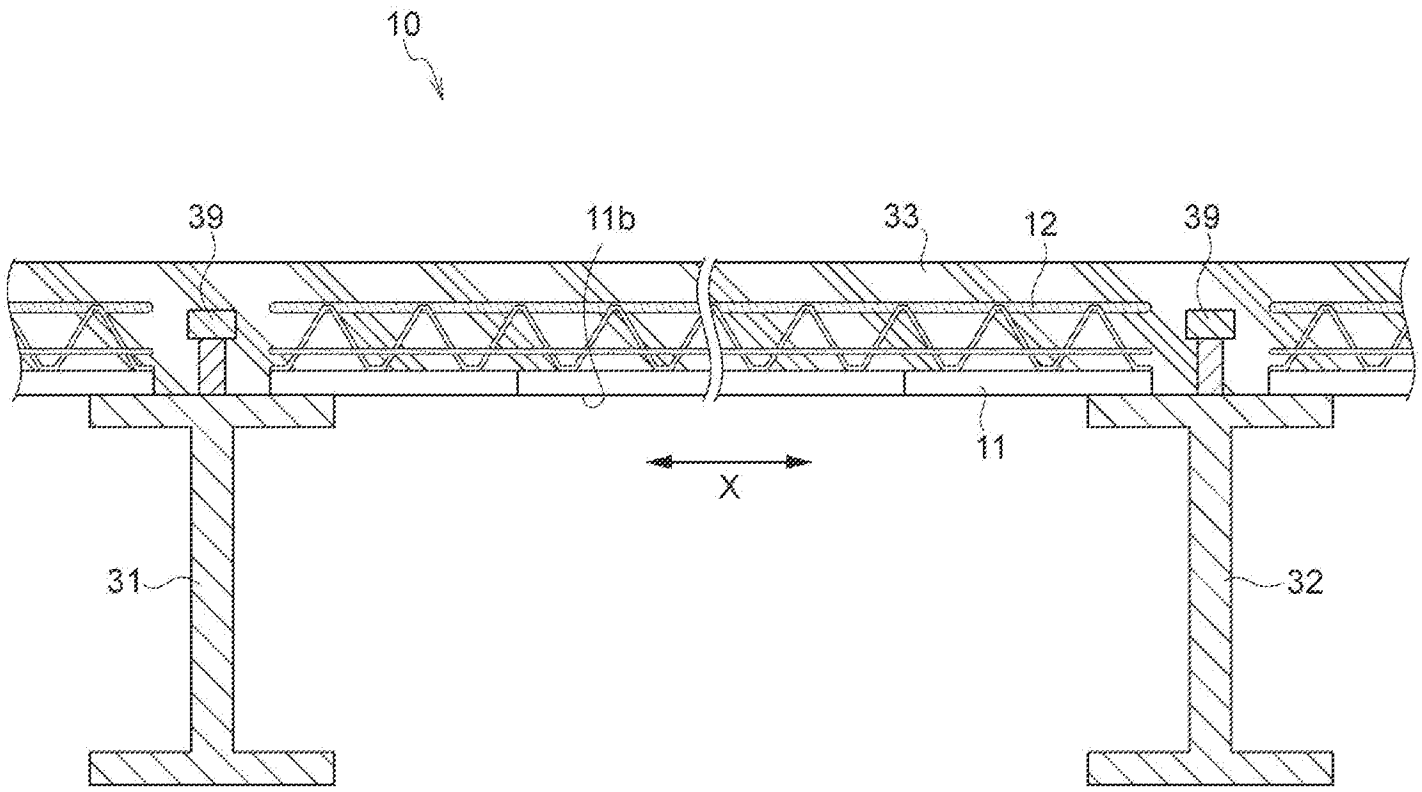
FIG. 10 is a view for explaining an example of a method of using a rebar-equipped lumber form according to the first embodiment.

Next, as a method of using a rebar-equipped lumber form 10, a new construction method in form rebar construction work for an RC floor will be described with reference to FIGS. 9 and 10. In FIGS. 9 and 10, reference numeral 39 denotes a headed stud.

First, as illustrated in FIG. 9, a rebar-equipped lumber form 10 is hoisted in a steel structure of a building 30, and the rebar-equipped lumber form 10 is laid with edges placed on the steel beams 31 and 32 in a direction such that the surface 11*b* of the wood panel 11, to which the unitized rebar (the rebar truss in the illustrated example) 12 is not fixed, is exposed downward from between the steel beams 31 and 32.

Next, as illustrated in FIG. 10, concrete 33 is placed and cured on the rebar-equipped lumber form 10 so as to cover the upper surface and the end surface of the rebar-equipped lumber form 10. Then, the rebar-equipped lumber form 10 is fixed to the steel beams 31 and 32 by the cured concrete 33. As a result, an RC floor is constructed.

As mentioned in the description on the background art, a conventional construction method has a problem that construction takes time, since it is necessary to weld the deck plate to the steel beams and dispose reinforcing bars on the deck plate after laying the deck plate constituting a form on the steel beams.

On the other hand, according to the present embodiment, since the panel part (i.e., wood panel 11) of the form is made of wood, it is unnecessary to weld the form to the steel beams 31 and 32 after laying the form on the steel beams 31 and 32 unlike the deck plate. Moreover, since the unitized rebar (e.g., rebar truss) 12 is fixed on the wood panel 11, it is unnecessary to perform the rebar arrangement construction work on site after laying the form on the steel beams 31 and 32, and it is possible to support the span from the beam 31 to the beam 32 without holding the span with timbering or the like until the strength of the concrete 33 is exhibited. Furthermore, in a state where the form is laid on the steel beams 31 and 32, since the surface 11*b* of the wood panel 11, to which the unitized rebar (e.g., rebar truss) 12 is not fixed, is exposed downward from between the steel beams 31 and 32, the surface 11*b* of the wood panel 11 exposed from between the steel beams 31 and 32 can be used as it is as a finishing material, and the finishing material, the base material, and the like can be omitted. Accordingly, by utilizing the rebar-equipped lumber form 10 in place of the deck plate, the construction time can be significantly shortened, and the finishing material and the base material can be omitted, so that the cost can be reduced.

Moreover, according to the present embodiment, since the length of each side of the wood panel 11 is equal to or longer than 1,000 mm, it is possible to bridge the wood panel 11 between a beam and another beam of the steel beams 31 and 32.

Moreover, according to the present embodiment, the wood panel 11 includes the plurality of laminas 11*a* arranged adjacent to each other in the width direction (X direction in FIG. 1), and laminas 11*a* adjacent to each other in the width direction (X direction) are bonded to each other, so that even a wood panel 11 having a large area can be prepared relatively easily.

Moreover, according to the present embodiment, since the first rebar member 21, the second rebar members 22*a* and 22*b*, and the third rebar members 23*a* and 23*b* of the rebar truss 12 extend in a direction parallel to the width direction (X direction in FIG. 1) of the laminas 11*a*, the strength of the wood panel 11 can be increased.

Note that various modifications can be made to the above-described embodiment. Hereinafter, an example of a variation will be described with reference to the drawings. In the following description and the drawings used in the following description, the same reference numerals as those used for the corresponding parts in the above-described embodiment are used for parts that can be configured similarly to the above-described embodiment, and redundant description is omitted.

Second Embodiment

Figure 12:
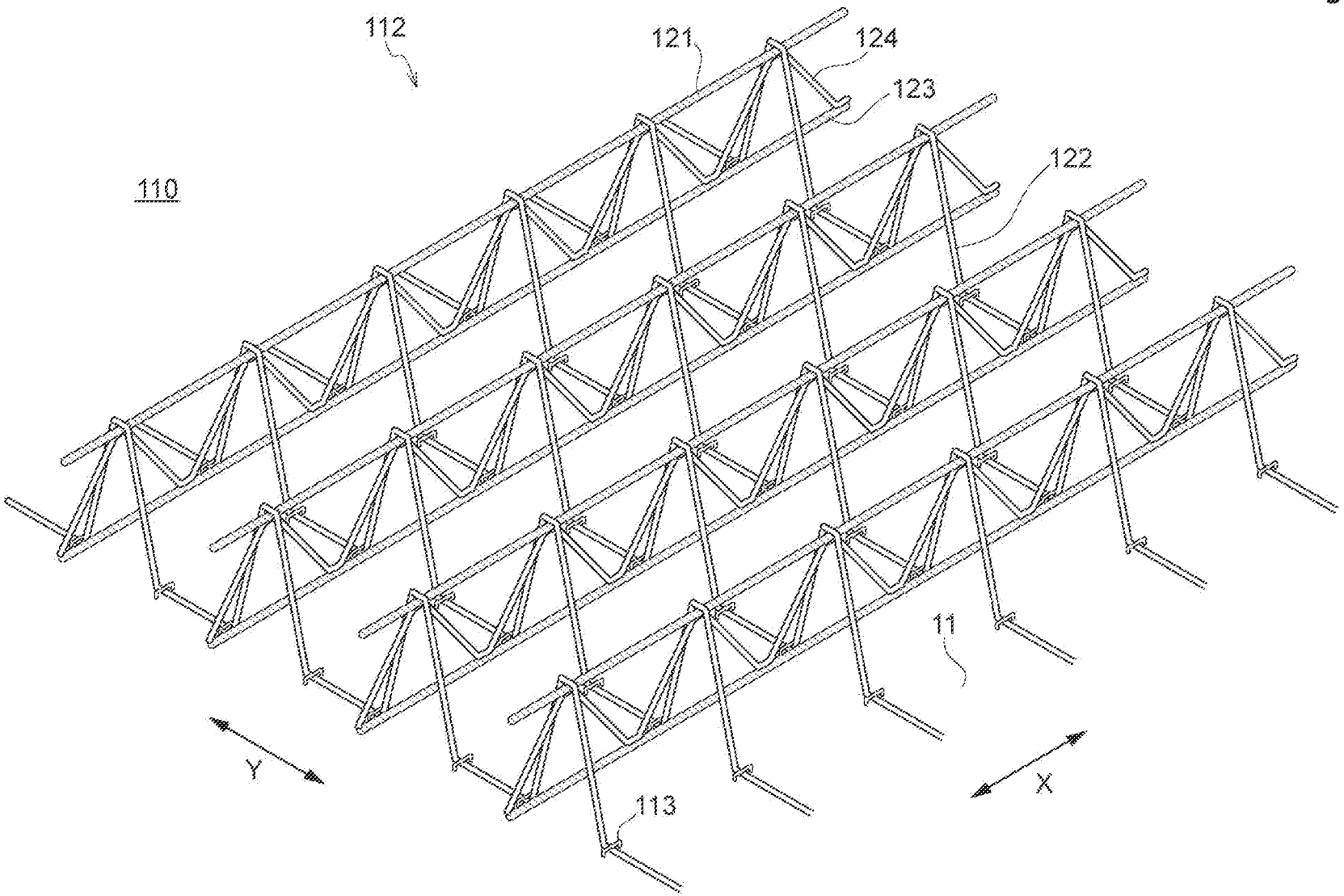
FIG. 12 is a perspective view illustrating a rebar-equipped lumber form according to a second embodiment.
Figure 13:
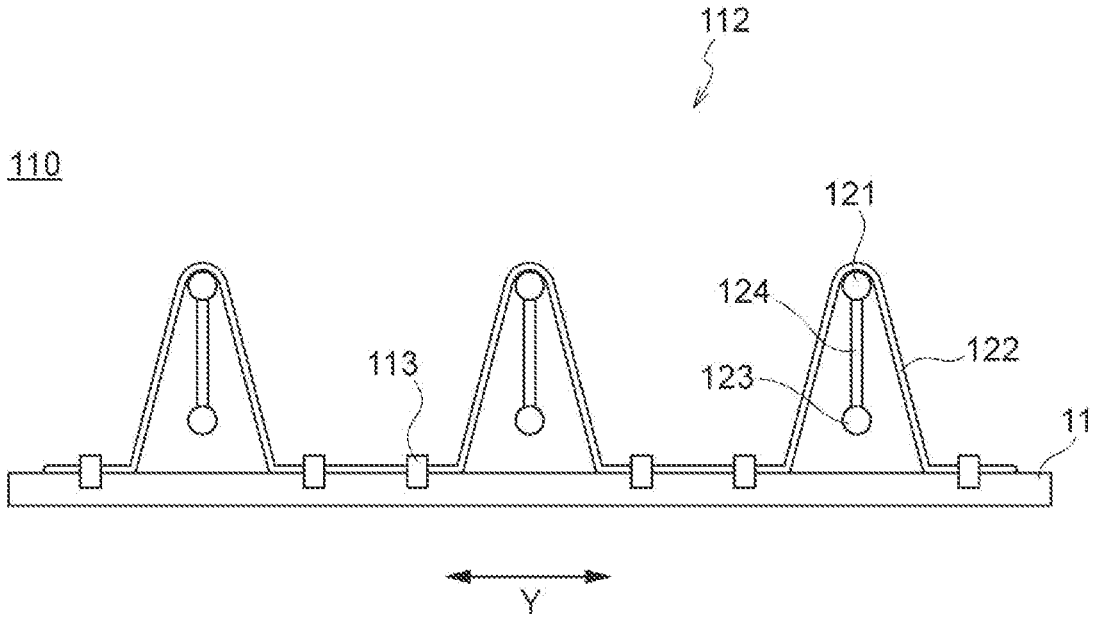
FIG. 13 is a cross-sectional view illustrating the rebar-equipped lumber form according to the second embodiment.

FIG. 12 is a perspective view illustrating a rebar-equipped lumber form 110 according to the second embodiment. FIG. 13 is a cross-sectional view illustrating the rebar-equipped lumber form 110 according to the second embodiment.

As illustrated in FIGS. 12 and 13, the rebar-equipped lumber form 110 according to the second embodiment has a wood panel 11 having a configuration similar to that of the first embodiment, a rebar truss 112 that is unitized rebar disposed on the wood panel 11, and fixing fittings 113 configured to fix the rebar truss 112 to the wood panel 11.

The above rebar truss 112 has a first rebar member 121, a second rebar member 122, a third rebar member 123, and a fourth rebar member 124. Specific dimensions of the first rebar member 121, the second rebar member 122, the third rebar member 123, and the fourth rebar member 124 may be appropriately determined according to required floor performance.

The first rebar member 121 is disposed above and spaced apart from the surface of the wood panel 11 and extends linearly along a first direction (X direction in the illustrated example) parallel to the surface of the wood panel 11.

The second rebar member 122 extends in a second direction (Y direction) perpendicular to the first direction (X direction) while repeatedly bending in the vertical direction in a triangular wave shape (zigzag) between the first rebar member 121 and the wood panel 11. The second rebar member 122 has an upper part facing the first rebar member 121 and a lower part facing the wood panel 11.

An upper part (i.e., a bent part facing the first rebar member 121) of the second rebar member 122 is welded to the first rebar member 121. A lower part (i.e., a part facing the wood panel 11) of the second rebar member 122 is fixed to the wood panel 11 with a fixing fitting 113. As the fixing fitting 113, a staple having a channel shape may be used, a combination of an F cable iron saddle and two fixing screws for screwing both ends of the F table iron saddle may be used, or a U nail having a "U" shape may be used. The staples and U nails may be adhesive or barbed. The number of fixing fittings 113 used for one spot of the lower part of the second rebar member 122 can be appropriately determined according to required performance.

The third rebar member 123 is disposed between the first rebar member 121 and the wood panel 11 and extends linearly along the first direction (X direction).

The fourth rebar member 124 extends in the first direction (X direction) while repeatedly bending in the vertical direction in a triangular wave shape (zigzag) between the first rebar member 121 and the third rebar member 123. The fourth rebar member 124 has an upper part facing the first rebar member 121 and a lower part facing the third rebar member 123.

An upper part (i.e., a bent part facing the first rebar member 121) of the fourth rebar member 124 is welded to the first rebar member 121, and a lower part (i.e., a bent part facing the third rebar member 123) of the fourth rebar member 124 is welded to the third rebar member 123.

With the rebar-equipped lumber form 110 according to the second embodiment as described above, effects similar to those of the first embodiment can be obtained. That is, since the panel part (i.e., wood panel 11) of the form is made of wood, it is unnecessary to weld the form to the steel beams 31 and 32 after laying the form on the steel beams 31 and 32 unlike the deck plate. Moreover, since the unitized rebar (rebar truss) 112 is fixed on the wood panel 11, it is unnecessary to perform rebar arrangement construction work on site after laying the form on the steel beams 31 and 32, and it is possible to support the span from the beam 31 to the beam 32 without holding the span with timbering or the like until the strength of the concrete 33 is exhibited. Furthermore, in a state where the form is laid on the steel beams 31 and 32, the surface of the wood panel 11, to which the unitized rebar (rebar truss) 112 is not fixed, is exposed downward from between the steel beams 31 and 32, so that the surface of the wood panel 11 exposed from between the steel beams 31 and 32 can be used as it is as a finishing material, and the finishing material, the base material, and the like can be omitted. Accordingly, by using the rebar-equipped lumber form 110 in place of the deck plate, the construction time can be significantly shortened, and the finishing material and the base material can be omitted, so that the cost can be reduced.

Third Embodiment

Figure 14:
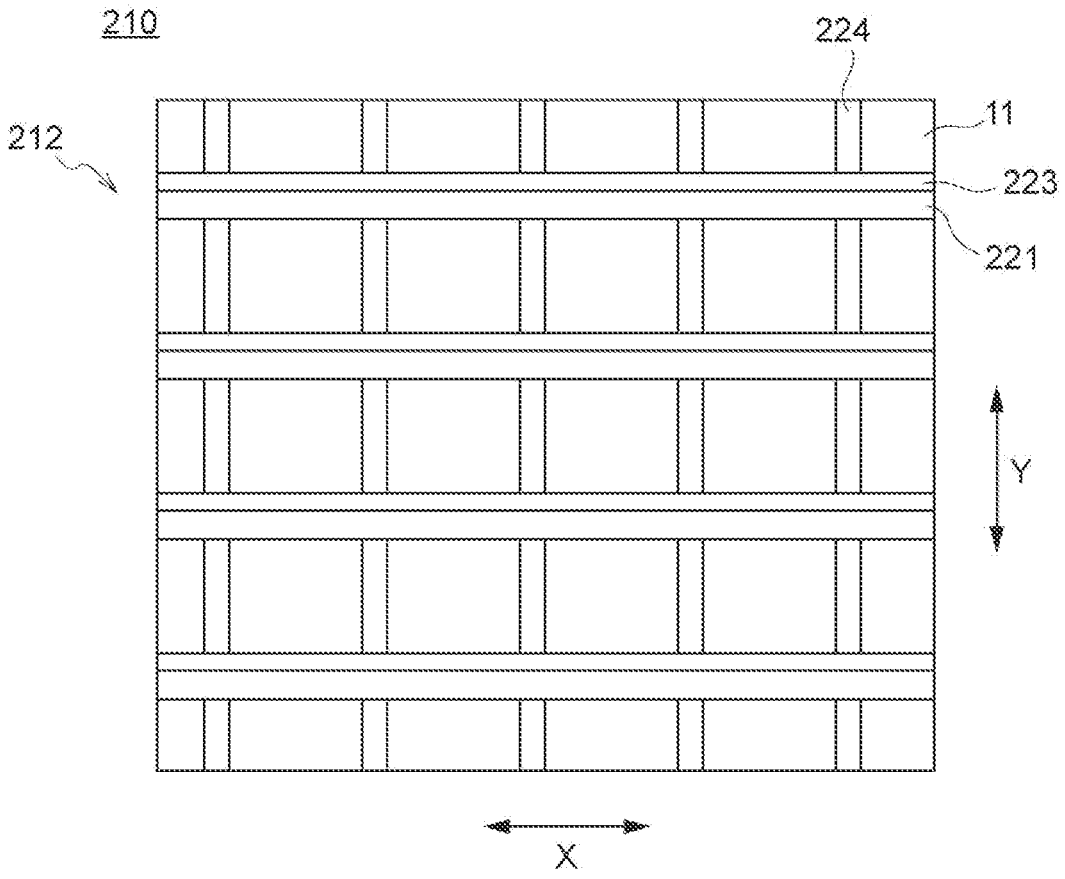
FIG. 14 is a top view illustrating a rebar-equipped lumber form according to a third embodiment.
Figure 15:
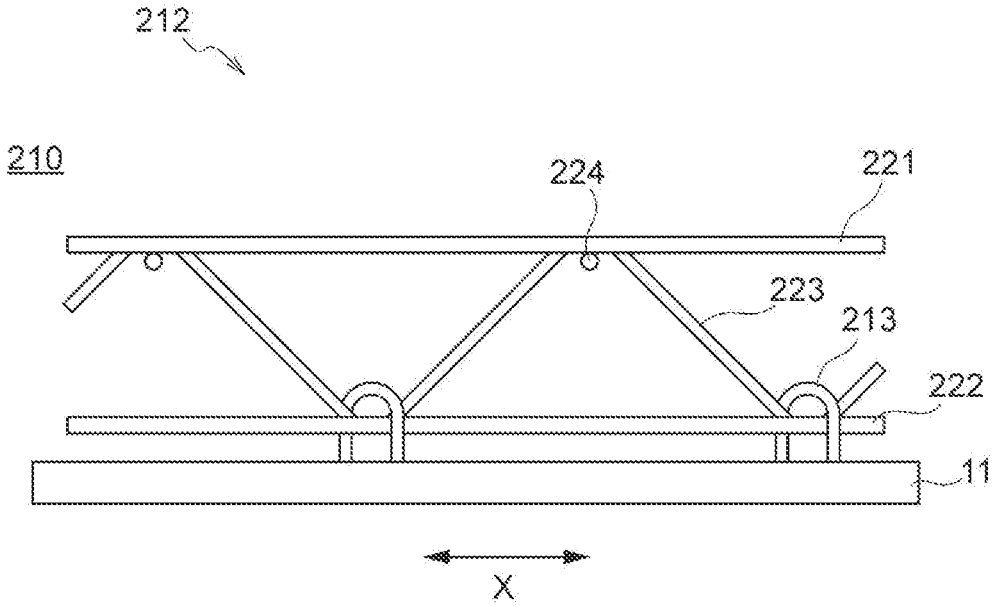
FIG. 15 is a cross-sectional view illustrating the rebar-equipped lumber form according to the third embodiment as viewed from the Y direction.
Figure 16:
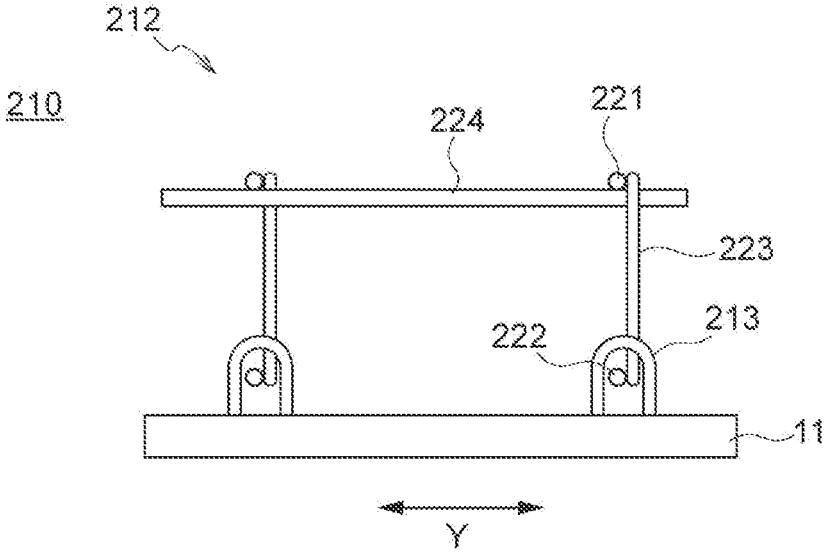
FIG. 16 is a cross-sectional view illustrating the rebar-equipped lumber form according to the third embodiment as viewed from the X direction.

FIG. 14 is a top view illustrating a rebar-equipped lumber form 210 according to the third embodiment. FIG. 15 is a cross-sectional view of the rebar-equipped lumber form 210 according to the third embodiment as viewed from the Y direction. FIG. 16 is a cross-sectional view of the rebar-equipped lumber form 210 according to the third embodiment as viewed from the X direction.

As illustrated in FIGS. 14 to 16, the rebar-equipped lumber form 110 according to the third embodiment has a wood panel 11 having a configuration similar to that of the first embodiment, a rebar truss 212 that is unitized rebar disposed on the wood panel 11, and fixing fittings 213 configured to fix the rebar truss 212 to the wood panel 11. In FIG. 14, illustration of the fixing fittings 213 is omitted.

The above rebar truss 212 has a first rebar member 221, a second rebar member 222, a third rebar member 223, and a fourth rebar member 224. Specific dimensions of the first rebar member 221, the second rebar member 222, the third rebar member 223, and the fourth rebar member 124 may be appropriately determined according to required floor performance.

The first rebar member 221 is disposed above and spaced apart from the surface of the wood panel 11 and extends linearly along a first direction (X direction in the illustrated example) parallel to the surface of the wood panel 11.

The second rebar member 222 is disposed between the first rebar member 221 and the wood panel 11 and extends linearly along the first direction (X direction).

The third rebar member 223 extends in the first direction (X direction) while repeatedly bending in the vertical direction in a triangular wave shape (zigzag) between the first rebar member 221 and the second rebar member 222. The third rebar member 223 has an upper part facing the first rebar member 221 and a lower part facing the second rebar member 222.

An upper part (i.e., a bent part facing the first rebar member 221) of the third rebar member 223 is welded to the first rebar member 221. A lower part (i.e., a bent part facing the second rebar member 222) of the third rebar member 223 is welded to the second rebar member 222 and is fixed to the wood panel 11 with a fixing fitting 213 having a "U" shape. The number of fixing fittings 213 used for one spot of the lower part of the third rebar member 223 can be appropriately determined according to required performance.

The fourth rebar member 224 extends immediately below the first rebar member 221 in a second direction (Y direction) perpendicular to the first direction (X direction) so as to intersect with the first rebar member 21. A part of the fourth rebar member 224 facing the first rebar member 221 is welded to the first rebar member 221.

With the rebar-equipped lumber form 210 according to the third embodiment as described above, effects similar to those of the first embodiment can be obtained. That is, since the panel part (i.e., wood panel 11) of the form is made of wood, it is unnecessary to weld the form to the steel beams 31 and 32 after laying the form on the steel beams 31 and 32 unlike the deck plate. Moreover, since the unitized rebar (rebar truss) 212 is fixed on the wood panel 11, it is unnecessary to perform the rebar arrangement construction work on site after laying the form on the steel beams 31 and 32, and it is possible to support the span from the beam 31 to the beam 32 without holding the span with timbering or the like until the strength of the concrete 33 is exhibited. Furthermore, in a state where the form is laid on the steel beams 31 and 32, the surface of the wood panel 11, to which the unitized rebar (rebar truss) 212 is not fixed, is exposed downward from between the steel beams 31 and 32, so that the surface of the wood panel 11 exposed from between the steel beams 31 and 32 can be used as it is as a finishing material, and the finishing material, the base material, and the like can be omitted. Accordingly, by utilizing the rebar-equipped lumber form 210 in place of the deck plate, the construction time can be significantly shortened, and the finishing material and the base material can be omitted, so that the cost can be reduced.

Although the lower parts of the unitized rebar (e.g., rebar truss) 12, 112, and 212 disposed on the wood panel 11 are fixed to the wood panel 11 with the fixing fittings 13, 113, and 213 in the above-described embodiments, the present invention is not limited this, and the lower parts of the unitized rebar (e.g., rebar truss) 12, 112, and 212 disposed on the wood panel 11 may be fixed to the wood panel 11 with an adhesive, or may be fixed to the wood panel 11 with both an adhesive and the fixing fittings 13, 113, and 213.

The description of the above-described embodiments and individual variation examples, and the disclosure of the drawings are merely examples for explaining the invention described in the claims, and the invention described in the claims is not limited by the description of the above-described embodiments and individual variation examples, or the disclosure of the drawings. The components of the above-described embodiments and individual variation examples can be arbitrarily combined without departing from the gist of the invention.

The invention claimed is:

1. A rebar-equipped lumber form characterized by comprising:

a wood panel; and a unitized rebar disposed and fixed on the wood panel, wherein the unitized rebar is fixed to the wood panel with an adhesive staple with a tensile load resistance to the wood panel that is more than 6 times higher than that of a staple, the wood panel includes a plurality of laminas arranged adjacent to each other in a width direction, the laminas adjacent to each other in the width direction being bonded and fixed to each other with an adhesive or connected with and fixed to each other with a staple, and the unitized rebar is placed and fixed across the plurality of laminas arranged and fixed adjacent to each other in the width direction, so that a strength of the wood panel including the plurality of laminas is increased.

2. The rebar-equipped lumber form according to claim 1, characterized in that a length of a long side of the wood panel is equal to or longer than 1,000 mm.

3. The rebar-equipped lumber form according to claim 1, characterized in that the unitized rebar is a rebar truss.

4. The rebar-equipped lumber form according to claim 3, characterized in that the rebar truss has:

a first rebar member that is disposed above and spaced apart from a surface of the wood panel and extends linearly along a first direction parallel to a surface of the wood panel;

a pair of second rebar members extending in the first direction while repeatedly bending in a vertical direction between the first rebar member and the wood panel, the pair of second rebar members each having an upper part facing the first rebar, a lower part facing the wood panel, and an intermediate part extending between the upper part and the lower part; and a pair of third rebar members that are disposed adjacent to the intermediate part of each of the pair of second rebar members and extend linearly along the first direction, an upper part of each of the pair of second rebar members is welded to the first rebar member, a lower part of each of the pair of second rebar members is fixed to the wood panel with the adhesive staple, and a part of an intermediate part of each of the pair of second rebar members, the part facing each of the pair of third rebar members, is welded to each of the pair of third rebar members.

5. The rebar-equipped lumber form according to claim 4, characterized in that the pair of second rebar members are arranged in mirror-image symmetry to each other with a plane extending perpendicularly to a surface of the wood panel from the first rebar member as a plane of symmetry, and the pair of third rebar members are arranged in mirror-image symmetry to each other with a plane extending perpendicularly to a surface of the wood panel from the first rebar member as a plane of symmetry.

6. The rebar-equipped lumber form according to claim 3, characterized in that the rebar truss has:

a first rebar member that is disposed above and spaced apart from a surface of the wood panel and extends linearly along a first direction parallel to a surface of the wood panel;

a second rebar member extending in a second direction perpendicular to the first direction while repeatedly bending in a vertical direction between the first rebar member and the wood panel, the second rebar member having an upper part facing the first rebar member and a lower part facing the wood panel;

a third rebar member that is disposed between the first rebar member and the wood panel and extends linearly along the first direction; and a fourth rebar member extending in the first direction while repeatedly bending in a vertical direction between the first rebar member and the third rebar member, the fourth rebar member having an upper part facing the first rebar member and a lower part facing the third rebar member, an upper part of the second rebar member is welded to the first rebar member, a lower part of the second rebar member is fixed to the wood panel with the adhesive staple, an upper part of the fourth rebar member is welded to the first rebar member, and a lower part of the fourth rebar member is welded to the third rebar member.

7. The rebar-equipped lumber form according to claim 3, characterized in that the rebar truss has:

a first rebar member that is disposed above and spaced apart from a surface of the wood panel and extends linearly along a first direction parallel to a surface of the wood panel;

a second rebar member that is disposed between the first rebar member and the wood panel and extends linearly along the first direction;

a third rebar member extending in the first direction while repeatedly bending in a vertical direction between the first rebar member and the second rebar member, the third rebar member having an upper part facing the first rebar member and a lower part facing the second rebar member; and a fourth rebar member extending in a second direction perpendicular to the first direction so as to intersect with the first rebar member, an upper part of the third rebar member is welded to the first rebar member, and a lower part of the third rebar member is welded to the second rebar member and fixed to the wood panel with the adhesive staple.

8. A method of manufacturing a rebar-equipped lumber form, the method comprising disposing a unitized rebar on a wood panel, and fixing a lower part of the unitized rebar to the wood panel with an adhesive staple with a tensile load resistance to the wood panel that is more than 6 times higher than that of a staple, wherein the wood panel includes a plurality of laminas arranged adjacent to each other in a width direction, the laminas adjacent to each other in the width direction being bonded and fixed to each other with an adhesive or connected with and fixed to each other with a staple, and the unitized rebar is placed and fixed across the plurality of laminas that are arranged and fixed adjacent to each other in the width direction, so that a strength of the wood panel including the plurality of laminas is increased.

9. A construction method in form rebar construction work for an RC floor, characterized by comprising:

a step of hoisting the rebar-equipped lumber form according to claim 1 and laying the rebar-equipped lumber form on steel beams in a direction such that a surface of the wood panel, to which the unitized rebar is not fixed, is exposed downward from between the steel beams; and a step of placing concrete on the rebar-equipped lumber form.

10. A building characterized by comprising:

steel beams;

a rebar-equipped lumber form according to claim 1 laid on the steel beams; and concrete placed on the rebar-equipped lumber form, wherein a surface of the wood panel of the rebar-equipped lumber form, to which the unitized rebar is not fixed, is exposed downward from between the steel beams.

* * * * *